US008308425B2

(12) United States Patent
Schmid

(10) Patent No.: US 8,308,425 B2
(45) Date of Patent: Nov. 13, 2012

(54) MINIPUMP

(75) Inventor: Noa Schmid, Kriens (CH)

(73) Assignee: CSEM Centre Suisse d'Electronique et de Microtechnique SA, Neuchatel (CH)

( * ) Notice: Subject to any disclaimer, the term of this patent is extended or adjusted under 35 U.S.C. 154(b) by 533 days.

(21) Appl. No.: 12/639,197

(22) Filed: Dec. 16, 2009

(65) Prior Publication Data

US 2010/0183459 A1 Jul. 22, 2010

(30) Foreign Application Priority Data

Jan. 20, 2009 (EP) ..... 09150926

(51) Int. Cl.
*F04D 5/00* (2006.01)

(52) U.S. Cl. ..... 415/90; 415/100; 415/146; 415/199.2

(58) Field of Classification Search ..... 415/90, 415/100, 146, 199.2
See application file for complete search history.

(56) References Cited

U.S. PATENT DOCUMENTS

| | | | | |
|---|---|---|---|---|
| 1,061,142 | A | 5/1913 | Nikola Tesla | |
| 2,910,223 | A | 10/1959 | Schlumbohm | |
| 4,421,412 | A * | 12/1983 | Hold et al. | 415/90 |
| 5,470,197 | A | 11/1995 | Cafarelli | |
| 7,097,416 | B2 | 8/2006 | Gurth | |
| 7,632,061 | B2 | 12/2009 | Neeb et al. | |
| 2006/0078436 | A1 | 4/2006 | Neeb et al. | |

FOREIGN PATENT DOCUMENTS

| | | |
|---|---|---|
| FR | 452 393 | 5/1913 |
| FR | 843 141 | 6/1939 |
| FR | 2 846 033 | 4/2004 |
| NL | 101 954 | 2/1962 |
| WO | WO 2004/077639 | 9/2004 |

* cited by examiner

*Primary Examiner* — Igor Kershteyn
(74) *Attorney, Agent, or Firm* — Martin Fleit; Paul D. Bianco; Fleit Gibbons Gutman Bongini & Bianco PL

(57) ABSTRACT

The present invention discloses an adhesion rotary disc pump comprising a housing embedding therein at least one adhesion-propelling disc mounted on a rotatable shaft that is drivable by a drive, wherein fluids engaging with said at least one adhesion-propelling disc are transportable from at least one inlet to at least one outlet. In embodiments, the pump employs a scraping unit operative to scrape off fluid adherent on both sides of each of the at least one rotatable adhesion-propelling disc and that the scraped-off fluid is being channeled directly or indirectly to the at least one outlet.

16 Claims, 18 Drawing Sheets

MINIPUMP

CROSS-REFERENCE TO RELATED APPLICATIONS

This Patent Application claims priority from EP Patent Application No. 09150926.5 filed on Jan. 20, 2009, the disclosure of which is incorporated herein by reference in its entirety.

FIELD OF THE INVENTION

The present invention refers to the field of pumps in general, and more specifically, to the field of adhesion-based pumps.

BACKGROUND OF THE INVENTION

Pumps that are propelling liquid on the basis adhesion, which are sometimes referred to as "Tesla pumps", usually comprise a housing having an inlet and an outlet. At least one adhesion-propelling disc is mounted on a rotatable shaft, which is drivable by a drive. Rotation of the at least one adhesion-propelling discs causes fluids engaging with the disc(s) to be transported from the inlet to the outlet by centrifugal force. Accordingly, the fluid inlet is centered, whereas the outlet of the fluid is located at the periphery of the pump. In the art, a variety of adhesion-based pumps have been conceived so far.

It should be noted that the term "adhesion" in association with the conveyance of fluid as used herein refers to any type of fluid-conveyance, wherein at least one fluid molecule is in adhesive contact with a surface such that movement of the surface results in the exertion of translation forces on the at least one fluid molecule. In turn, other molecules that are not in contact with the surface but directly or indirectly with the at least one molecule may be subjected to shear forces. As a consequence, movement of the surface may cause conveyance of fluid comprising of the at least one fluid molecule and the other molecules.

U.S. Pat. No. 1,06,1142 discloses a machine for propelling or imparting energy to fluids comprising in combination a plurality of spaced disks rotatably mounted and having plane surfaces, an inclosing casing, ports of inlet at the central portion of the casing through which the fluid is to be introduced to the axial portions of the disks, and ports of outlet at the peripheral portion of the casing through which the fluid, when the machine is drive by power, is to be expelled.

U.S. Pat. No. 7,097,416, entitled "Rotary Disc Pump", to Gurth, discloses a rotary disc pump for pumping fluid materials. The rotary disc pump comprises a housing having a front and a back wall forming a chamber with a generally coaxial inlet in the front wall and a generally tangential outlet, an impeller is mounted co-axially within the chamber and comprises a shaft mounted in the back wall of said housing and having an outer end emanating from the housing and an inner end within the chamber, at least a first circular which is disc mounted on the inner end of the shaft, and at least a second disc which is mounted in axially spaced relation to the first disc and has an opening in the center thereof, arid a conical member which emanates co-axially of the shaft from the first disc toward the second disc.

French patent application 2 846 033 to Ribaud, discloses a Tesla pump comprising a casing, a rotor with several plane, spaced, parallel coaxial discs rotating on a shaft. The assembly is surrounded by an external spiraled volute. An internal spiraled volute is housed in a central cavity inside the disc assembly. The internal end of each internal volute communicates through an internal channel with one of the casing fluid inlet and outlet openings.

Patent application WO2004/077639, entitled "Pump or turbine, drive unit comprising such a pump or turbine and outboard motor" to Neeb et al., discloses a pump or turbine comprising a housing provided with at least one chamber, a rotor, which is rotatably mounted on a shaft in the chamber, an inlet, which communicates with the chamber at least at the location of the shaft, and an outlet channel, which communicates with the chamber at least at the periphery of the rotor. The pump or turbine moreover comprises at least one bypass channel, a first end of which opens into the outlet channel of the pump and a second end of which forms an inlet.

BRIEF DESCRIPTION OF THE FIGURES

Features of the invention will become more clearly understood in the light of the ensuing description of a some embodiments thereof, given by way of example only, with reference to the accompanying figures, wherein.

DESCRIPTION OF THE EMBODIMENTS OF THE INVENTION

Figure 1A:
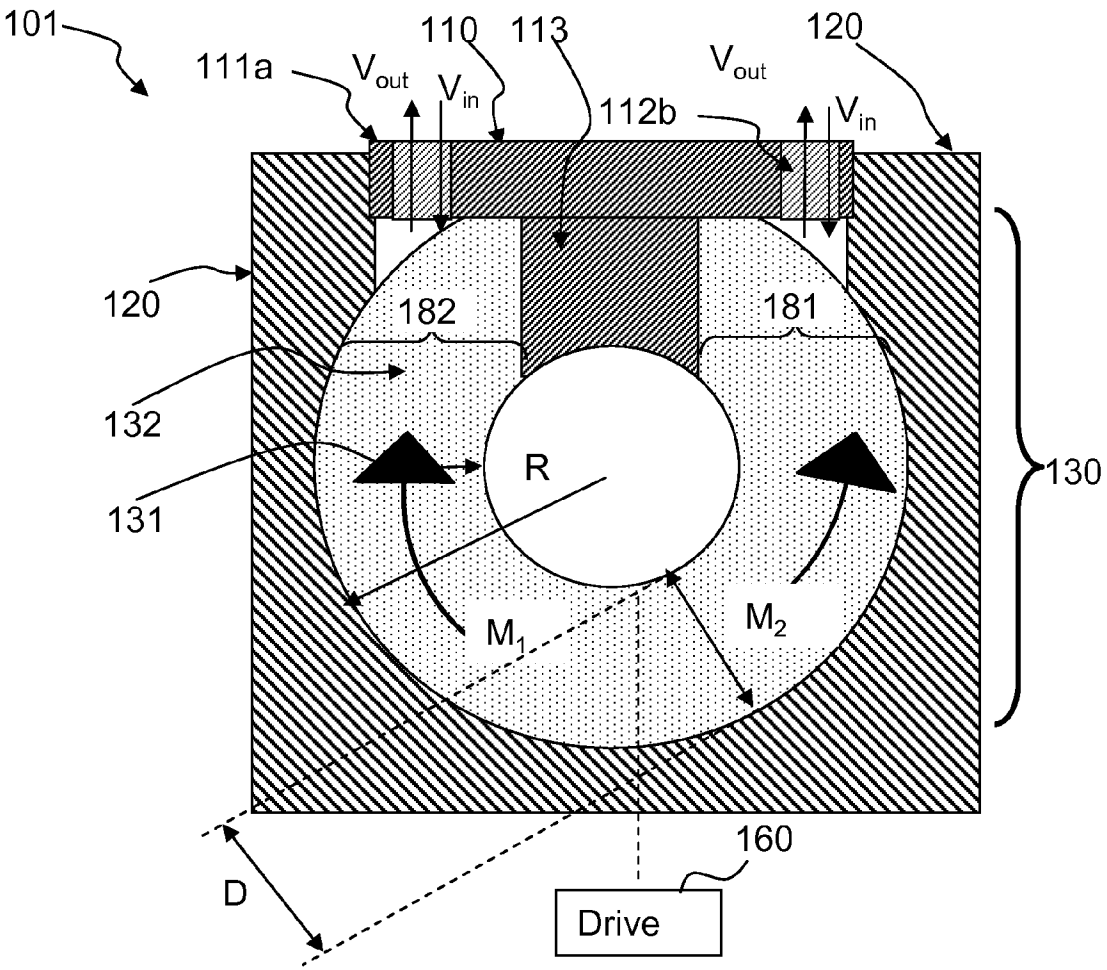
FIG. 1A is a schematic cross-sectional general front view illustration of a first adhesion rotary disc pump, according to an embodiment of the invention.

It is an object of the invention, inter alia, to provide an alternative adhesion-based rotary disc pump wherein both the inlet and the outlet are at the pump housing's periphery, and/or wherein the pump enables bidirectional transportation of the fluid.

Summary of Embodiments of the Invention

The present invention discloses an adhesion rotary disc pump that includes a housing and a cover.

In an embodiment of the invention, the housing houses at least one adhesion-propelling disc mounted on a rotatable shaft that is drivable by a drive. The at least one adhesion-propelling disc has a thickness t and two faces of area A. According to an embodiment of the invention, the thickness of the discs may be, for example, larger than the width W of the grooves between the discs. Fluids engaging with the at least one adhesion-propelling disc are transportable from at least one inlet of the cover to at least one outlet of the cover. A scraping unit features at least one scraping pane that is positionable in the housing such to be operative to interact with or engage the at least one adhesion-propelling disc such to scrape off fluid adherent on at least one face of the at least one rotatable adhesion-propelling disc. Scraped-off fluid is being channeled directly or indirectly to the at least one outlet.

In an embodiment of the invention, a plurality of adhesion-propelling discs is mounted on the rotatable shaft, wherein the plurality of adhesion-propelling discs are jointly interacting with or engaging the scraping unit.

In an embodiment of the invention, each of the plurality of adhesion-propelling discs communicates with a respective one of the at least one inlet and the at least one outlet.

In an embodiment of the invention, a first inlet of the at least one inlet communicates with a first adhesion-propelling disc and a final outlet of the at least one outlet communicates with a final adhesion-propelling disc, the scraping unit channeling the adhesively conveyed fluid received at the first inlet to the final outlet via a directly successive adhesion-propelling disc.

In an embodiment of the invention, each of the plurality of adhesion-propelling discs communicates with a respective one of the at least one inlet and the at least one outlet, wherein a first inlet of the at least one inlet communicates with a first adhesion-propelling disc and a final outlet of the at least one outlet communicates with a final adhesion-propelling disc, the scraping unit channeling the adhesively conveyed fluid received at the first inlet to the final outlet via a directly successive adhesion-propelling disc.

In an embodiment of the invention, the scraping panes terminate in respective concave surfaces that complimentary abut against the cylindrical surface of the shaft.

In an embodiment of the invention, the scraping panes have a horizontal cross-section of a parallelogram such that the scraping panes feature one or two line-like scraping-edges running from the cover towards the shaft.

In an embodiment of the invention, the scraping panes terminate in respective concave surfaces that complimentary abut against the cylindrical surface of the shaft wherein the scraping panes have a horizontal cross-section of a parallelogram such that the scraping panes feature one or two line-like scraping-edges running from the cover towards the shaft.

In an embodiment of the invention, the scraping panes have fluid-conveying faces emanating from the line-like scraping edges.

In an embodiment of the invention, the drive and thus the adhesion-propelling discs are bidirectionally drivable.

In an embodiment of the invention, the cover includes at least one funnel to funnel the fluid either to the at least one inlet or outlet.

In an embodiment of the invention, the housing has an opening that is partitioned by tapered and/or angled teeth into a plurality of fluid-conveying chambers, In an embodiment of the invention, the angle of teeth correspond to the direction of conveyance of the fluid.

In an embodiment of the invention, the at least one disc setup of at least one first adhesion propelling disc communicates in series with at least one second adhesion propelling disc via a central fluid-conveying chamber, wherein the first at least one adhesion propelling disc communicates with the inlet, and wherein the at least one second adhesion propelling disc communicates with the outlet.

In an embodiment of the invention, the drive is a brushless motor such that the adhesion rotary disc pump is seal-less movable or rotatable, i.e., the brushless motor is free of a seal.

In an embodiment of the invention, the at least one scraping pane is mechanically coupled to the cover.

In an embodiment of the invention, the at least one scraping pane is uncoupled from the cover and thus individually placeable in the housing.

Detailed Description Of The Invention

Figure 2A:
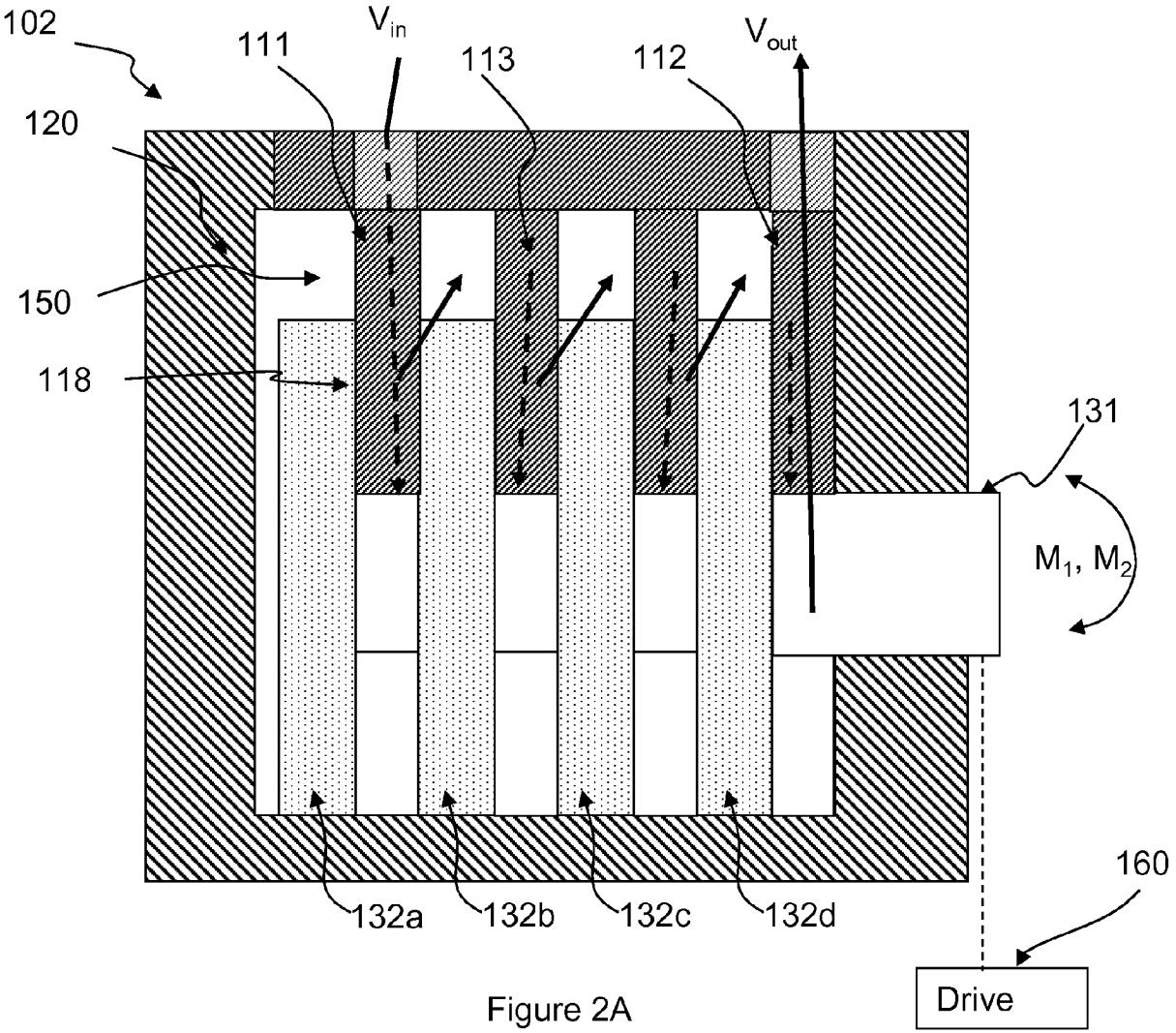
FIG. 2A is a schematic cross-sectional general side view illustration of a second adhesion rotary disc pump, according to an alternative embodiment of the invention.
Figure 2B:
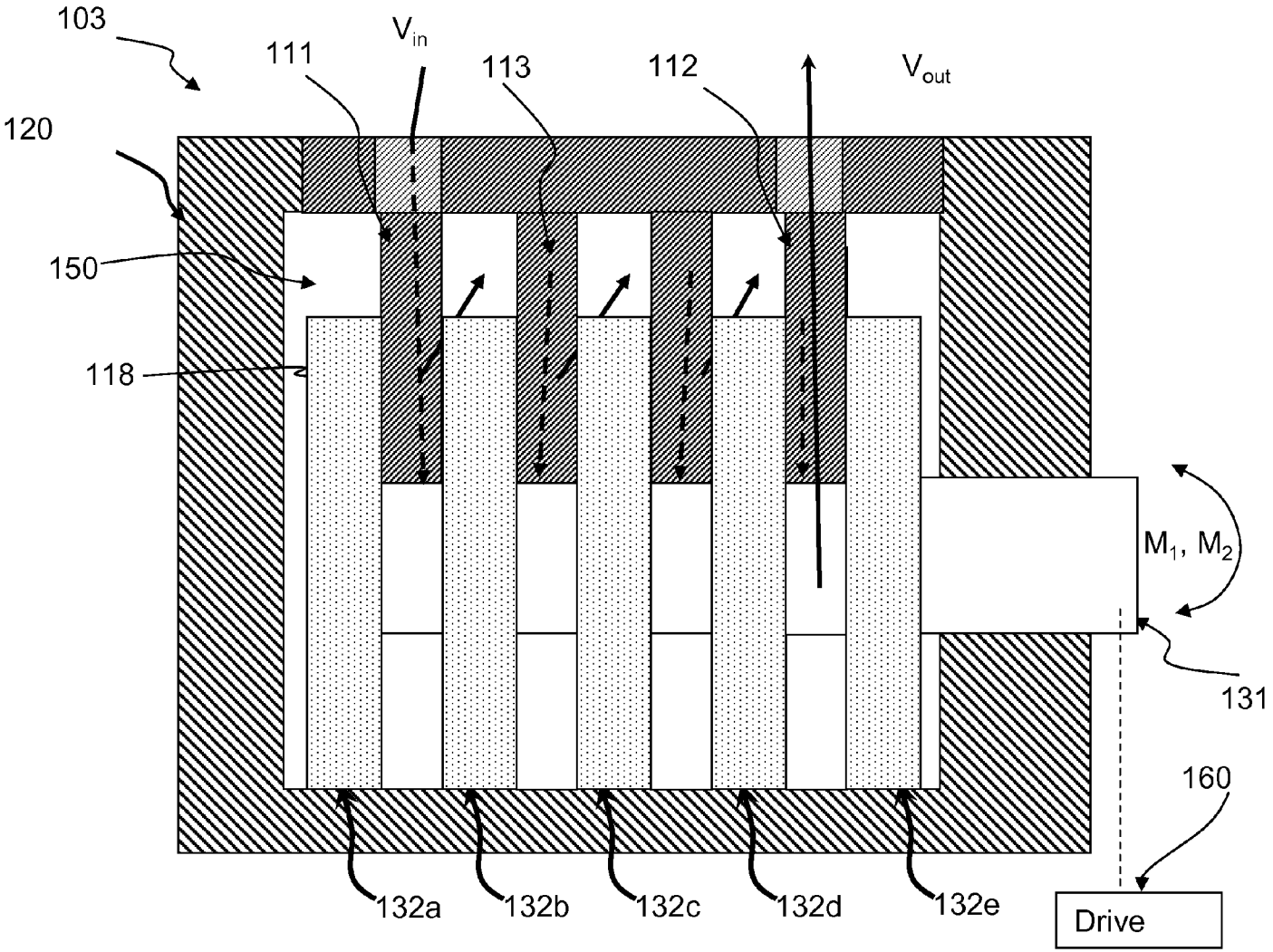
FIG. 2B is a schematic cross-sectional general side view illustration of a third adhesion rotary disc pump according to a yet alternative embodiment of the invention.

Reference is now made to FIG. 1A and FIG. 2B. According to an embodiment of the invention, a first adhesion rotary disc pump 101 comprises a housing 120 embedding therein a rotor 130 having a shaft 131 and at least one adhesion-propelling disc 132. The radius R of rotor 130 measured from its rotational axis Z to the perimeter of at least one adhesion-propelling disc 132 is, for example, less than 25 mm. Two neighboring adhesion-propelling discs 132 may be spaced from one another, thus forming grooves 334 having a width W of, for example, less than 0.5 mm. The depth D of grooves 334 may range, for example, from ¼ to ¾ of the radius R of rotor 130. Adhesion-propelling disc(s) 132 may be integrally formed with shaft 131 or fixedly attached to shaft 131. Housing 120 further comprises at least one inlet 111 and at least one outlet 112. The at last one adhesion-propelling disc 132 is mounted on a rotatable shaft 131 such that a space 150 is present between the cover of scraping unit 110 and the cylindrical surface of adhesion propelling discs 132. By rotating the at least one adhesion-propelling disc 132, fluids engaging therewith may be transported from the at least one inlet 111 to the at least one outlet 112, inter alia, via space 150. As is schematically indicated with arrows M1 and M2, shaft 131 is bidirectionally rotatable.

In embodiments, first adhesion rotary disc pump 101 may include a scraping unit 110, which may be detachable from housing 120. Scraping unit 110 may be positioned relative to the at least one adhesion-propelling disc 132 in a manner such that fluid that is adhesively transported towards scraping unit 110 is scraped off by the same. More specifically, a plurality of adhesion-propelling discs 132 may be mounted on rotatable shaft 131, wherein the plurality of adhesion-propelling discs 132 are jointly engaging scraping unit 110 such that fluid adherent to rotating adhesion-propelling discs 132 may be scraped off. The fluid may be scraped off only from one side or from both sides of adhesion-propelling disc 132, both options yielding scraped-off fluid.

In an embodiment, each of the plurality of adhesion-propelling discs 132 communicates with a respective one of the at least one inlet 111 and the at least one outlet 112. For example, a first inlet and outlet pair 111*a*/112*a* communicates with a first adhesion-propelling disc 132*a*, a second inlet and outlet pair 111*b*/112*b* communicates with a second adhesion-propelling disc 132*b* and so forth. According to some alternative embodiments, a pair of spaced neighboring adhesion-propelling discs 132*a* and 132*b*; 132*b* and 132*c* etc., communicates with first inlet and outlet pair 111*a* and 112*a*, second inlet and outlet pair 111*b* and 112*b* etc., respectively. Consequently, the scraped-off fluid may be channeled directly from the at least one inlet 111 to the at least one outlet 112. For example, fluid may be adhesively transported from first inlet 111*a* to first outlet 112*a* by first adhesion-propelling disc 132*a*, or by first and second adhesion-propelling disc 132*a* and 132*b*.

Further reference is now made to FIG. 2A. According to some embodiments of the invention, inlet 111 of a second rotary disc pump 102 communicates with first adhesion-propelling disc 132*a*, whereas an outlet, embodied in an exemplified manner by outlet 112, communicates with a final adhesion-propelling disc, exemplified by adhesion-propelling disc 132*d*. Scraping unit 110 and housing 120 may be configured such that rotation of shaft 131 causes fluid received at inlet 111 to be adhesively conveyed and channeled to outlet 112 via directly successive adhesion-propelling discs. For example, inlet 111 communicates with first adhesion-propelling disc 132*a*, which through rotation may adhesively transports fluid to a first of the at least one scraping pane 113 each having scraping edges 118. The fluid may then be scraped off and channeled due to pressure towards the planar side of second adhesion-propelling disc 132*b* via its circular edge. The planar side of second adhesion-propelling disc 132*b* may then further adhesively transport the fluid towards second scraping pane 113. Second scraping pane of the at least one scraping pane 113 may then scrape off the fluid from second adhesion-propelling disc 132*b* and so forth until scraped-off fluid reaches outlet 112. According to some embodiments, first adhesion-propelling disc 132*a* may directly communicate with inlet 111 and second adhesion-propelling disc 132*b* may communicate directly with outlet 112. Thusly configured, second adhesion-propelling disc 132*b* may embody the final adhesion-propelling disc.

Additional reference is now made to FIG. 2B. Third adhesion rotary disc pump 103 may employ an auxiliary adhesion-propelling disc (e.g., adhesion-propelling disc 132*e*), which together with final adhesion-propelling disc 132*d* communicates with outlet 112. Therefore, final adhesion-propelling disc 132*d* as well as auxiliary adhesion-propelling disc 132*e* jointly channels fluid through outlet 112.

According to some embodiments of the invention, a drive 160 may be operatively coupled with rotor 130. Drive 160 may be selectably operated in either one of a clockwise or counterclockwise direction. Accordingly, shaft 131, and with it together the at least one adhesion-propelling disc 132, may be bidirectionally drivable, as is schematically illustrated with arrows $M_1$ and $M_2$. Consequently, fluid may be transported, directly or indirectly, at one instance from the at least one inlet 111 to the at least one outlet 112, and another instance, vice versa, i.e., the at least one inlet 111 may constitute the at least one outlet 112, and the at least one outlet 112 may constitute the at least one inlet 111.

Figure 3:
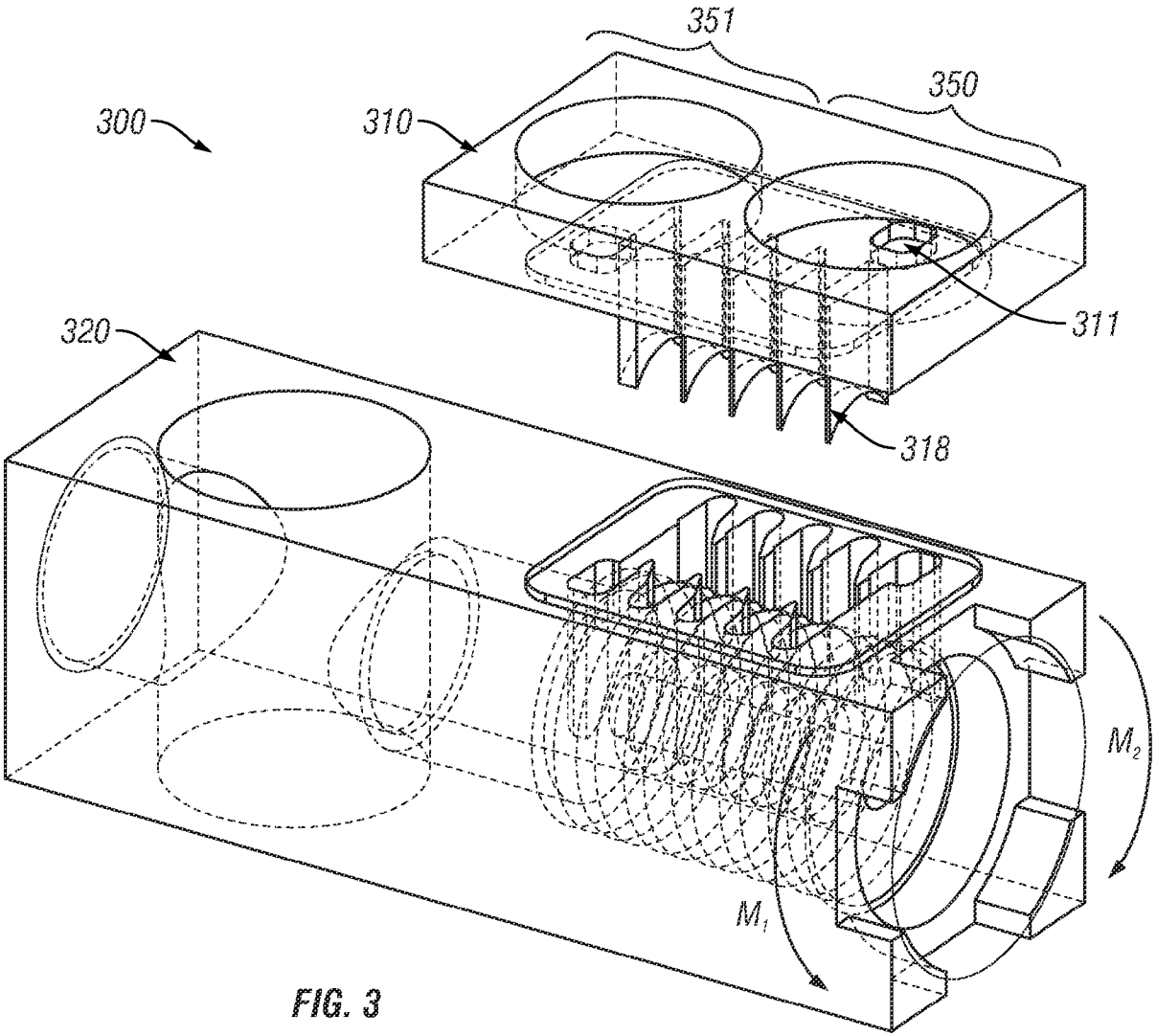
FIG. 3 is a schematic isometric partially exploded view of a given adhesion rotary disc pump, according to an embodiment of the invention.

Further reference is now made to FIG. 3. In embodiments, a given adhesion rotary disc pump 300, which may for example be similarly configured like third rotary disc pump 103, may comprise a scraping unit 310 constituting a cover of a housing 320 whereon the at least one scraping pane 313 may be comb-like mounted.

Figure 4:
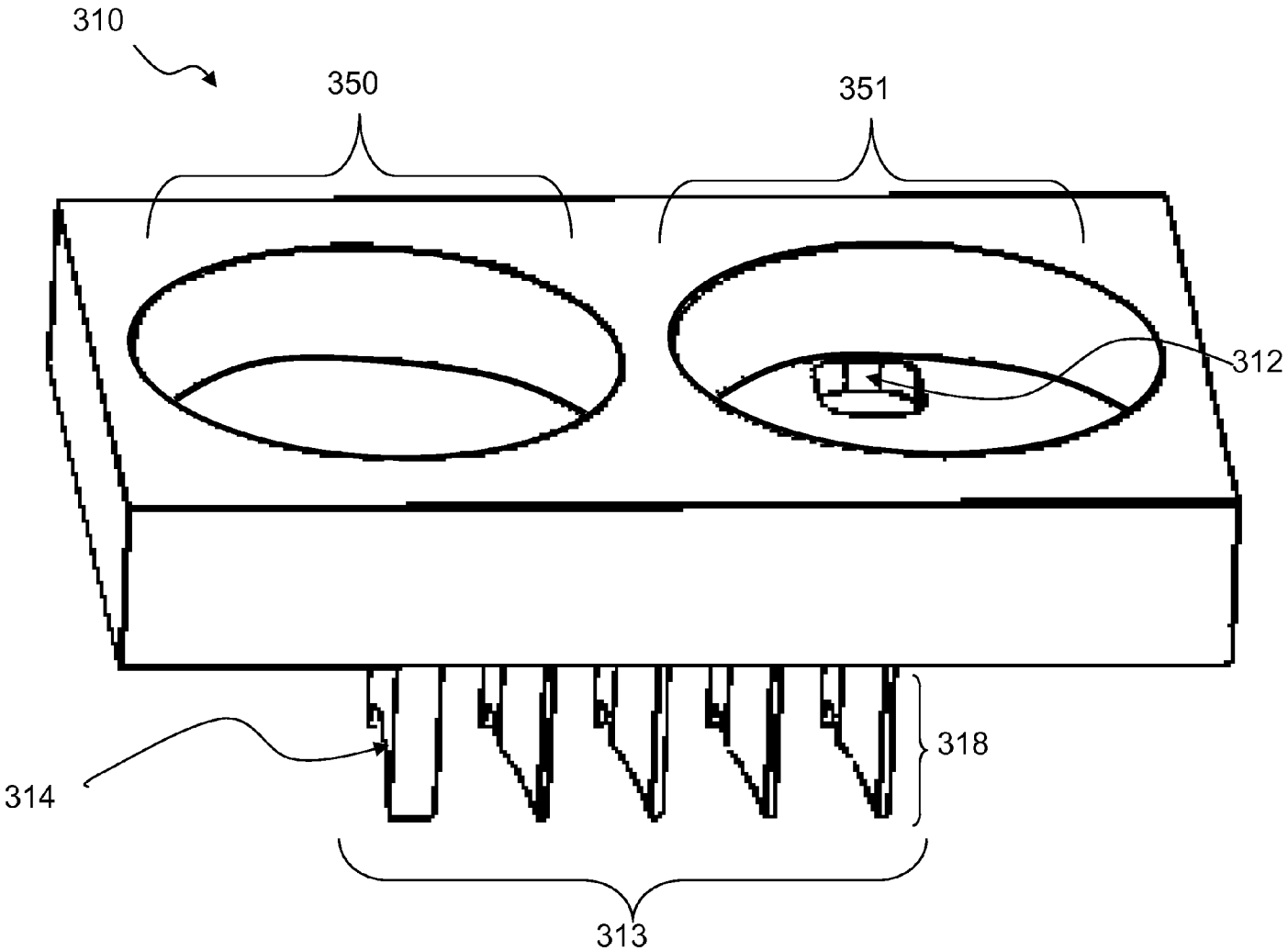
FIG. 4 is a schematic isometric illustration of a scraping unit of the adhesion rotary disc pump, according to an embodiment of the invention.
Figure 5:
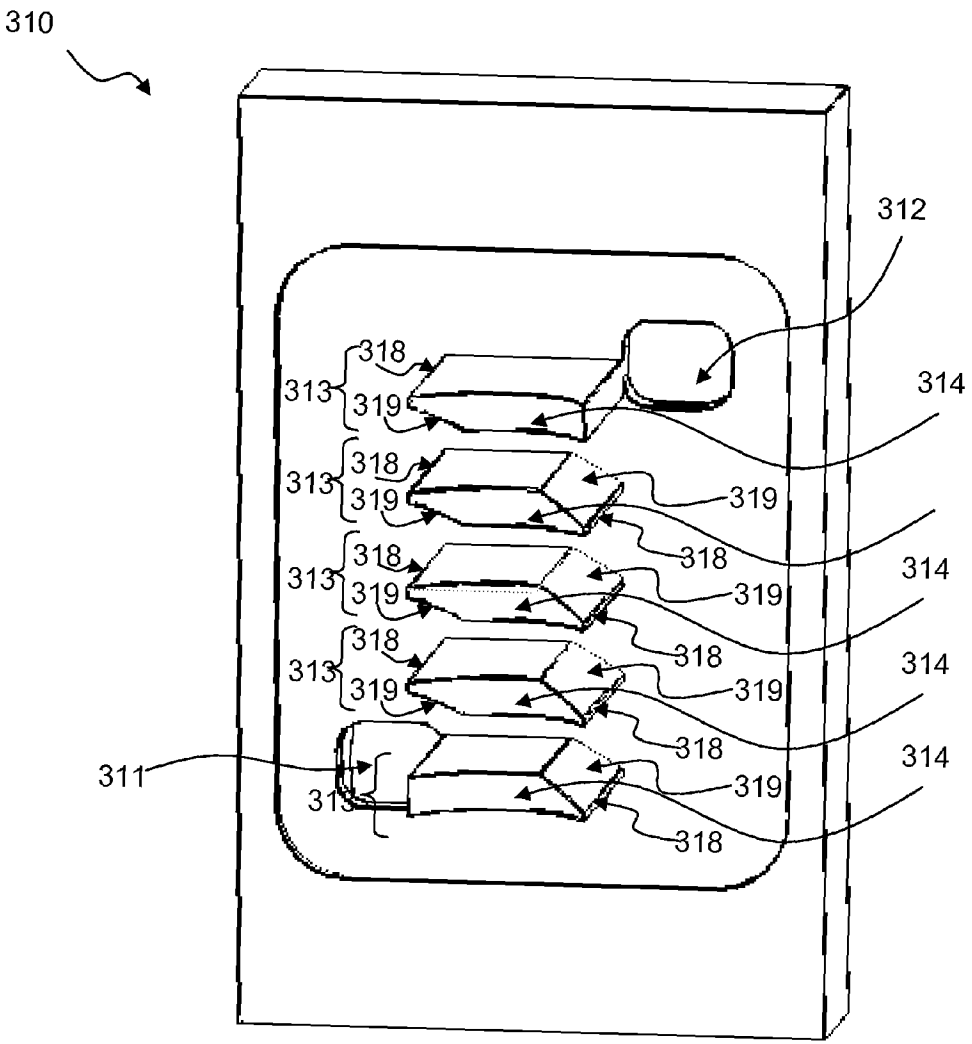
FIG. 5 is a schematic isometric bottom view illustration of the scraping unit, according to the embodiment of FIG. 3.

Additionally referring now to FIG. 4 and FIG. 5, a horizontal cross-section of the at least one scraping pane 313 may generally have the form of a parallelogram. Thusly configured, the at least one scraping pane 313 features one or two line-like scraping-edges 318 running from the cover towards a shaft 331, as well as fluid-channeling or fluid-conveying faces 319 emanating from the line-like scraping edges 318. The horizontal cross-sectional views of the scraping panes 313 that communicate with inlet 311 and outlet 312 may feature a right-angle at the side of inlet 311 and outlet 312.

During rotational movement of at least one adhesion-propelling disc 332, adhesively propelled fluid is caused to engage with line-like scraping-edge 318, which in turn scrapes off the adhesive fluid away from adhesion-propelling disc(s) 332. Since the scraped-off fluid is continuously being subjected to pressure due to the rotational movement of adhesion-propelling disc(s) 332, the fluid is channeled toward outlet 312. Which one of the two line-like scraping edges 318 engages with and scrapes off the conveyed fluid, depends on the rotational direction of the at least one adhesion-propelling disc 332. Since the at least one scraping pane 313 may be tapered towards line-like scraping edge 318, the dynamic pressure exerted by line-like scraping edge 318 on the fluid minimizes the moments $M_1$ and/or $M_2$ required for transporting a given amount fluid from inlet 311 to outlet 312. It should be noted that adhesion-propelling disc(s) 332 may be integrally formed or fixedly coupled to shaft 331.

Figure 1B:
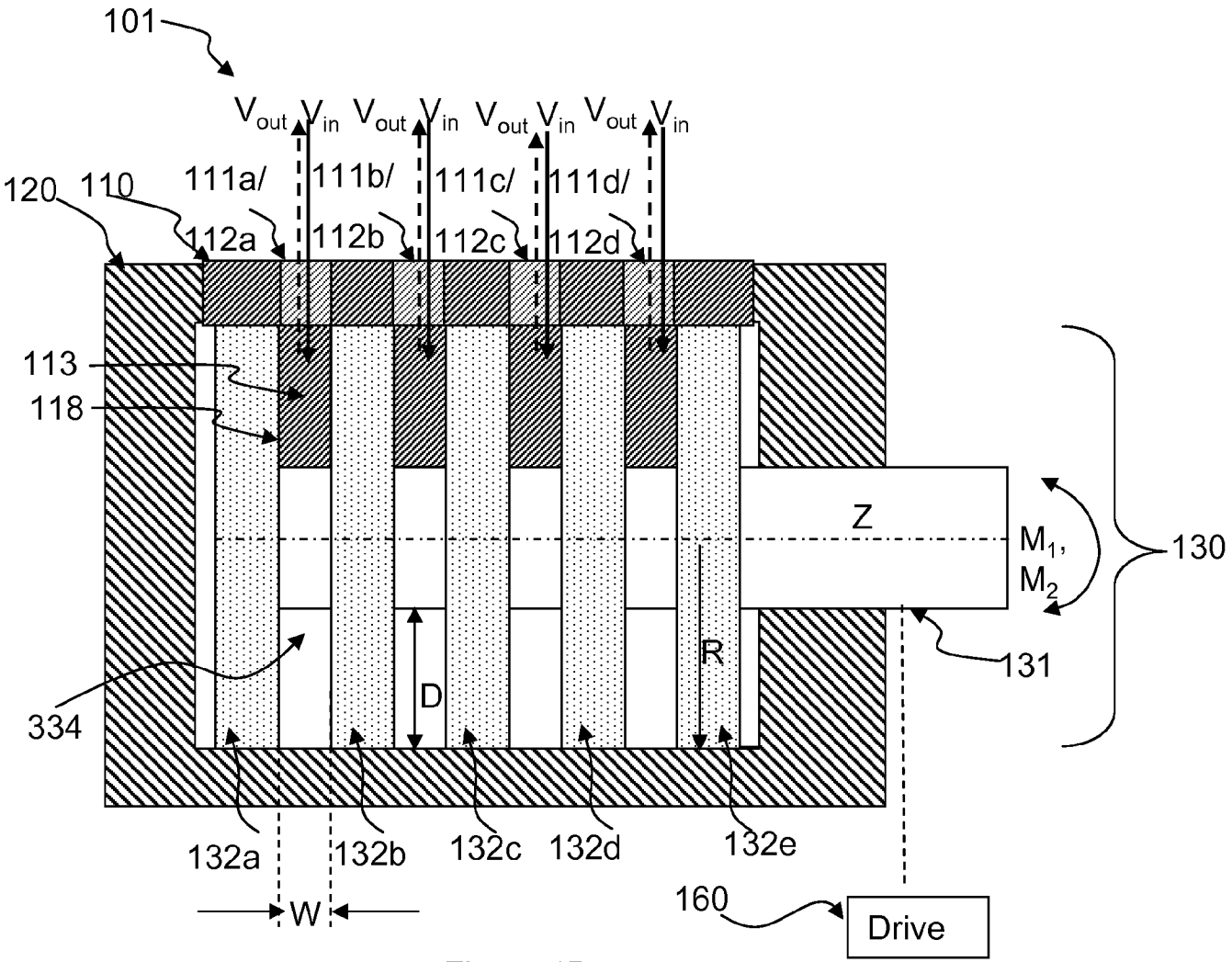
FIG. 1B is a schematic cross-section general side view illustration of the first adhesion rotary disc pump, according to the embodiment of FIG. 1A.
Figure 6:
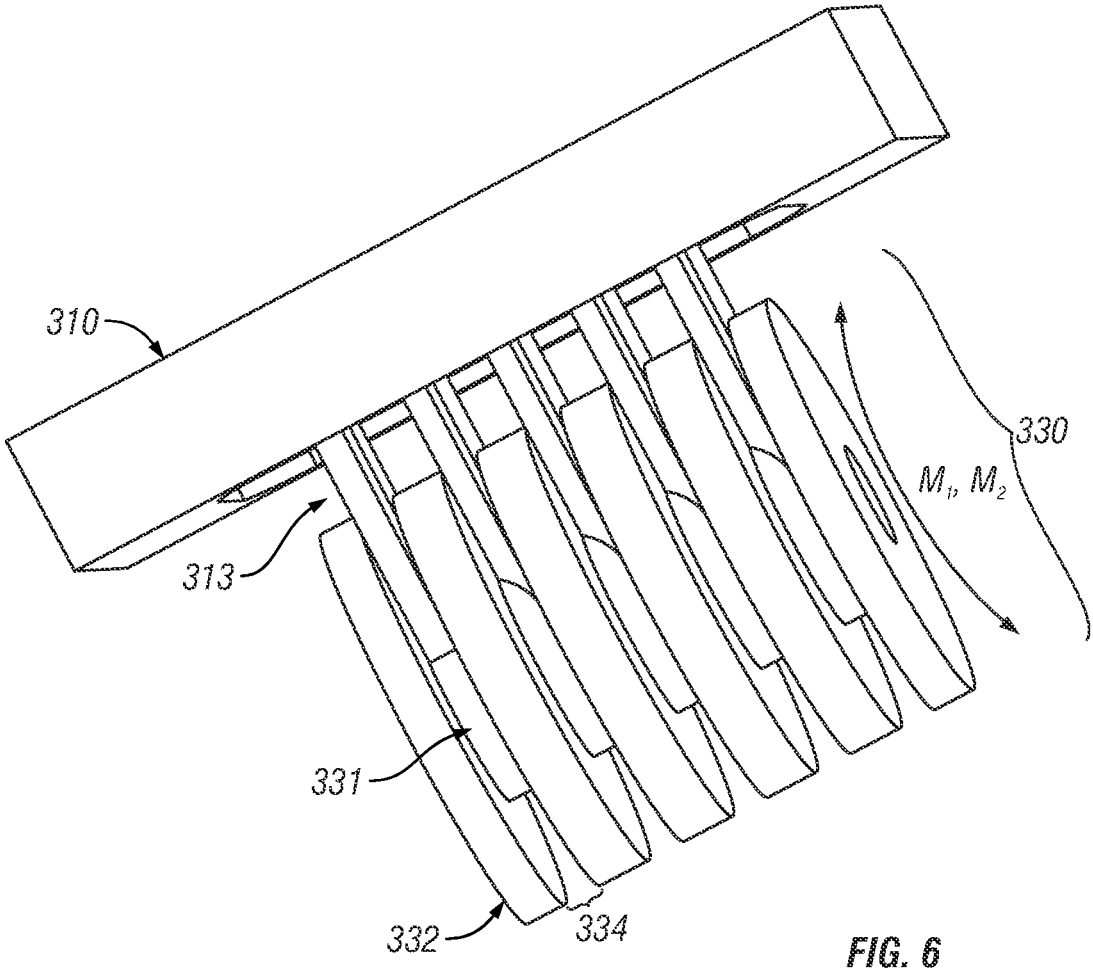
FIG. 6 is a schematic isometric illustration of the scraping unit in operative engagement with a rotor, according to an embodiment of the invention.
Figure 7:
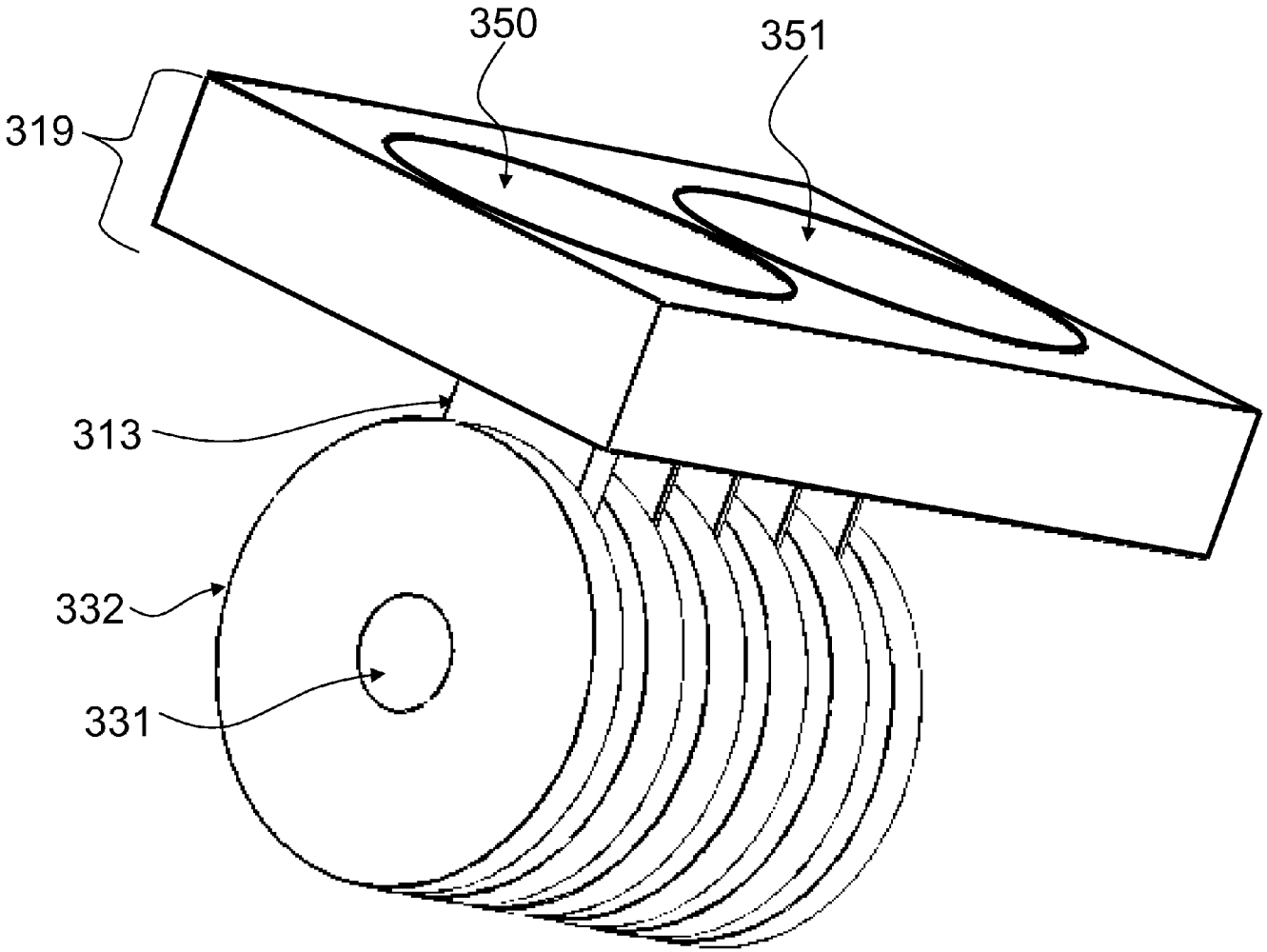
FIG. 7 is another schematic isometric illustration of the scraping unit in operative engagement with the rotor, according to the embodiment of FIG. 6.

Further reference is now made to FIG. 6 and FIG. 7. According to some embodiments of the invention, the at least one scraping pane 313 engaging with a given rotor 330 may terminate in a concave surface 314, which may optionally abut in a complimentary manner against the cylindrical surface of shaft 331. Thusly configured, scraping pane(s) 313 substantially seal the section of adhesion-propelling disc(s) 332 that receives the fluid (hereinafter: "fluid-receiving section") from the section that propels the fluid towards the respective scraping pane 313 (hereinafter: "fluid-propelling section"). Therefore, leakage of fluid from the fluid-propelling section back to the fluid-receiving section may be avoided or mized. Assuming a rotation as indicated by arrow $M_1$ (FIG. 1), the fluid-receiving and fluid-propelling sections are respectively referenced 181 and 182.

According to some embodiments of the invention, scraping unit 310 may include at least one funnel, which may be respective of the number of inlets and outlets. For example, as is inter alia schematically illustrated in FIG. 7, scraping unit 310 may include a first funnel 350 and a second funnel 351 terminating in inlet 311 and outlet 312, respectively. If shaft 331 is rotatably driven as is schematically indicated with arrow $M_1$, then fluid may be funneled through first funnel 350 to inlet 311. Conversely, if shaft 331 rotatably driven in the direction that is schematically indicated with arrow $M_2$, then fluid may be funneled through second funnel 351 towards outlet 312, which may in this case constitute an inlet to given adhesion-propelling disc pump 300.

Figure 8:
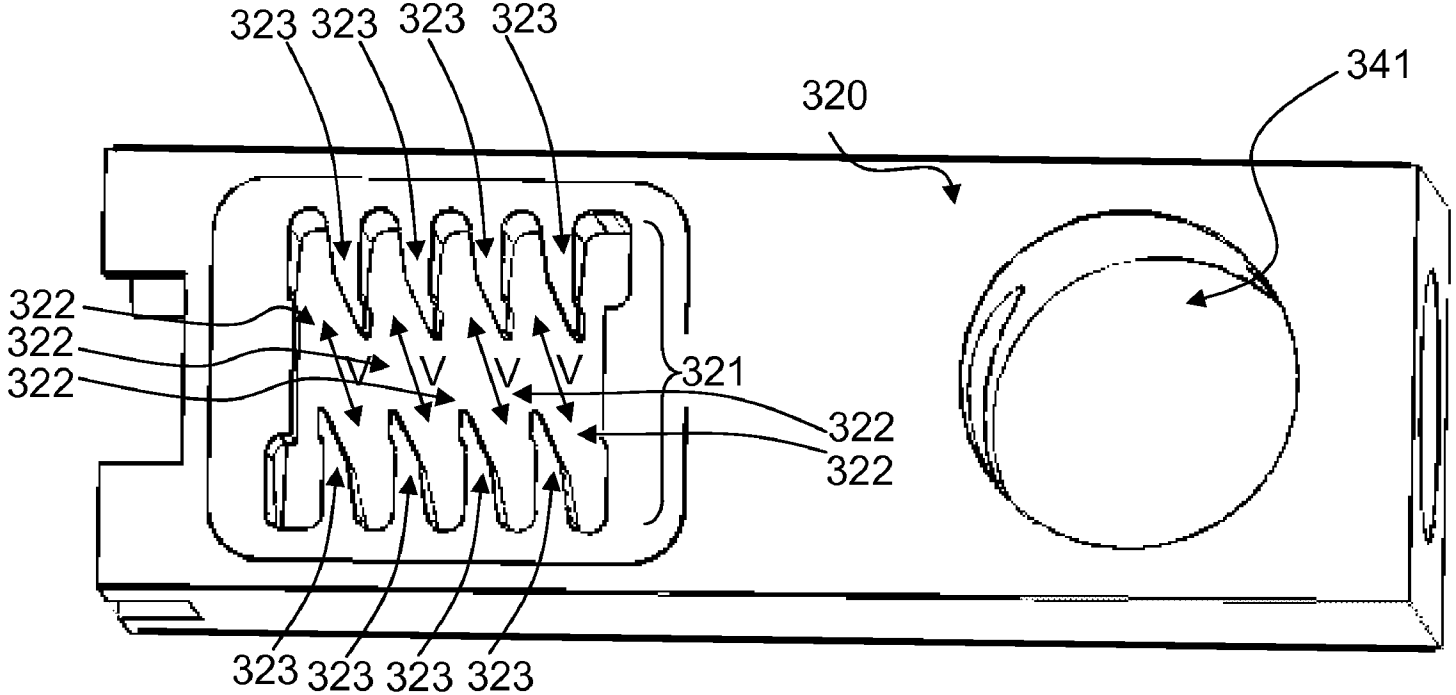
FIG. 8 is a schematic isometric top view illustration of a housing of the given adhesion rotary disc pump, according to an embodiment of the invention.

Further reference is now made to FIG. 8. According to some embodiments of the invention, housing 320 may include an opening 321 that may be partitioned by tapered and/or angled teeth 323 into a plurality of fluid-conveying chambers 322. The angle of teeth 323 may correspond to the direction of conveyance of the fluid, as is schematically indicated with arrows V. In accordance with the bidirectionally rotatable fluid adhesion discs 332, fluid direction arrows V too are illustrated as being bidirectionally.

Figure 9:
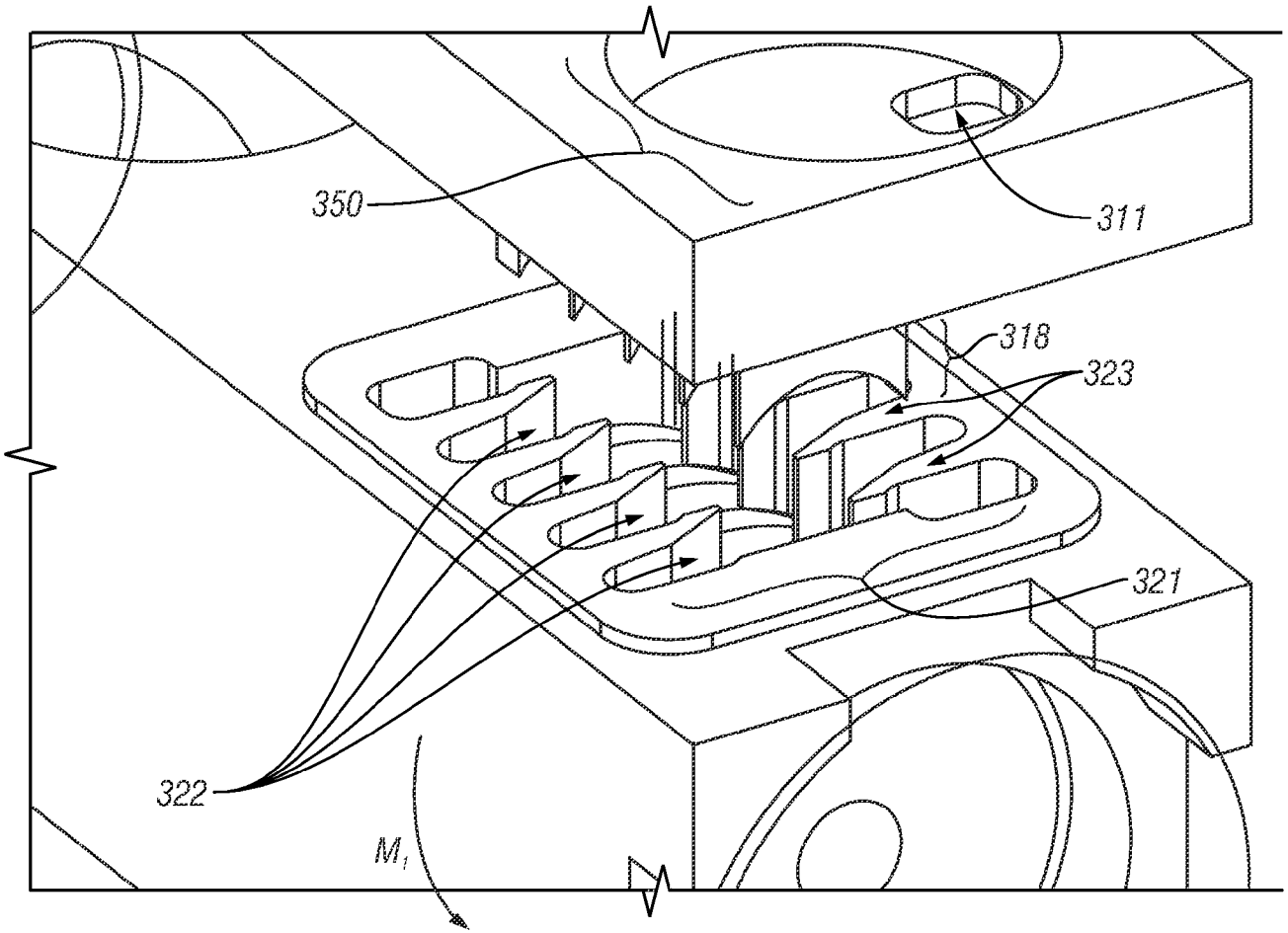
FIG. 9 is another schematic isometric partially exploded view of the given adhesion rotary disc pump, according to an embodiment of the invention.
Figure 10:
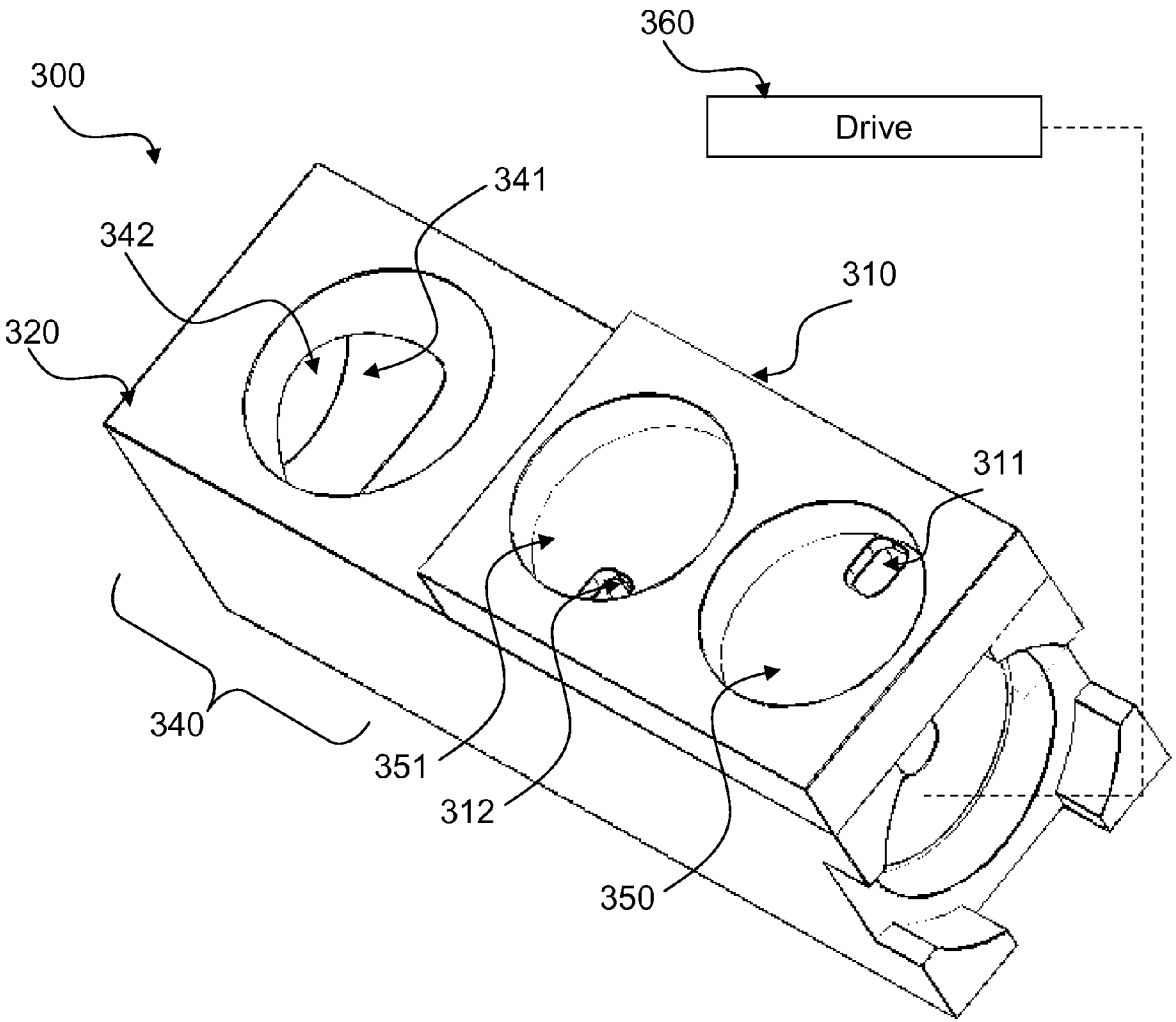
FIG. 10 is a schematic isometric assembly illustration of the given adhesion rotary disc pump, according to an embodiment of the invention.

Additionally referring now to FIG. 9 and to FIG. 10, opening 321 may be operative to receive scraping unit 310 such that each fluid adhesion disc 332 fits into the respective conveying chamber 322.

According to some embodiments of the invention, given adhesion rotary disc pump 300 may comprise a seating 340 operative to receive bearing(s) and/or rotary seal(s) via seating openings 341 and/or 312.

Shaft 331 may be operatively coupled with a drive 360, which may in some embodiments, be embedded in housing 320 (cf. FIG. 15A, FIG. 15B and FIG. 16) and in some other embodiments be external to housing 320.

Figure 11:
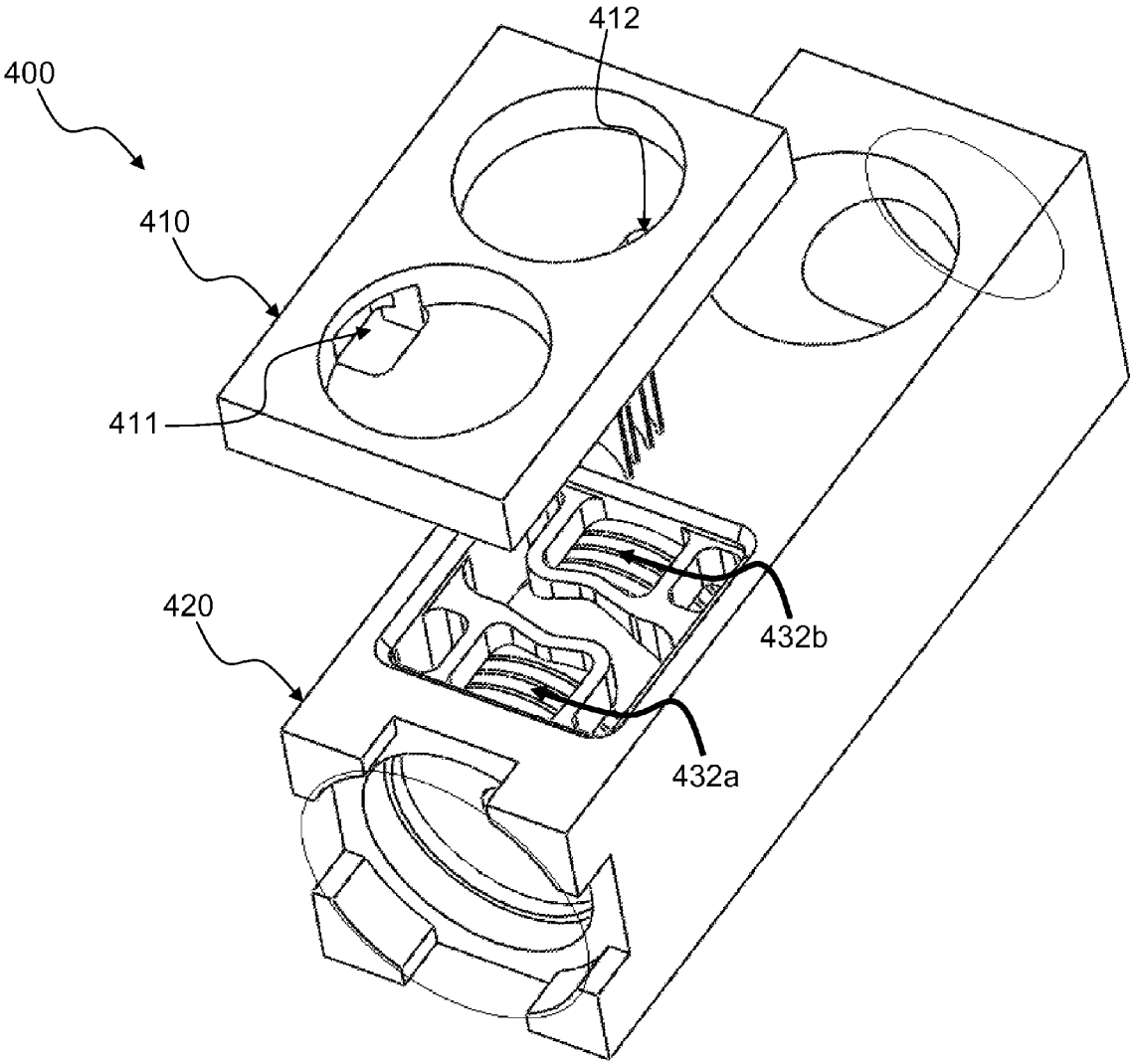
FIG. 11 is a schematic isometric partial exploded view illustration of another adhesion rotary disc pump, according to an alternative embodiment of the invention.
Figure 12:
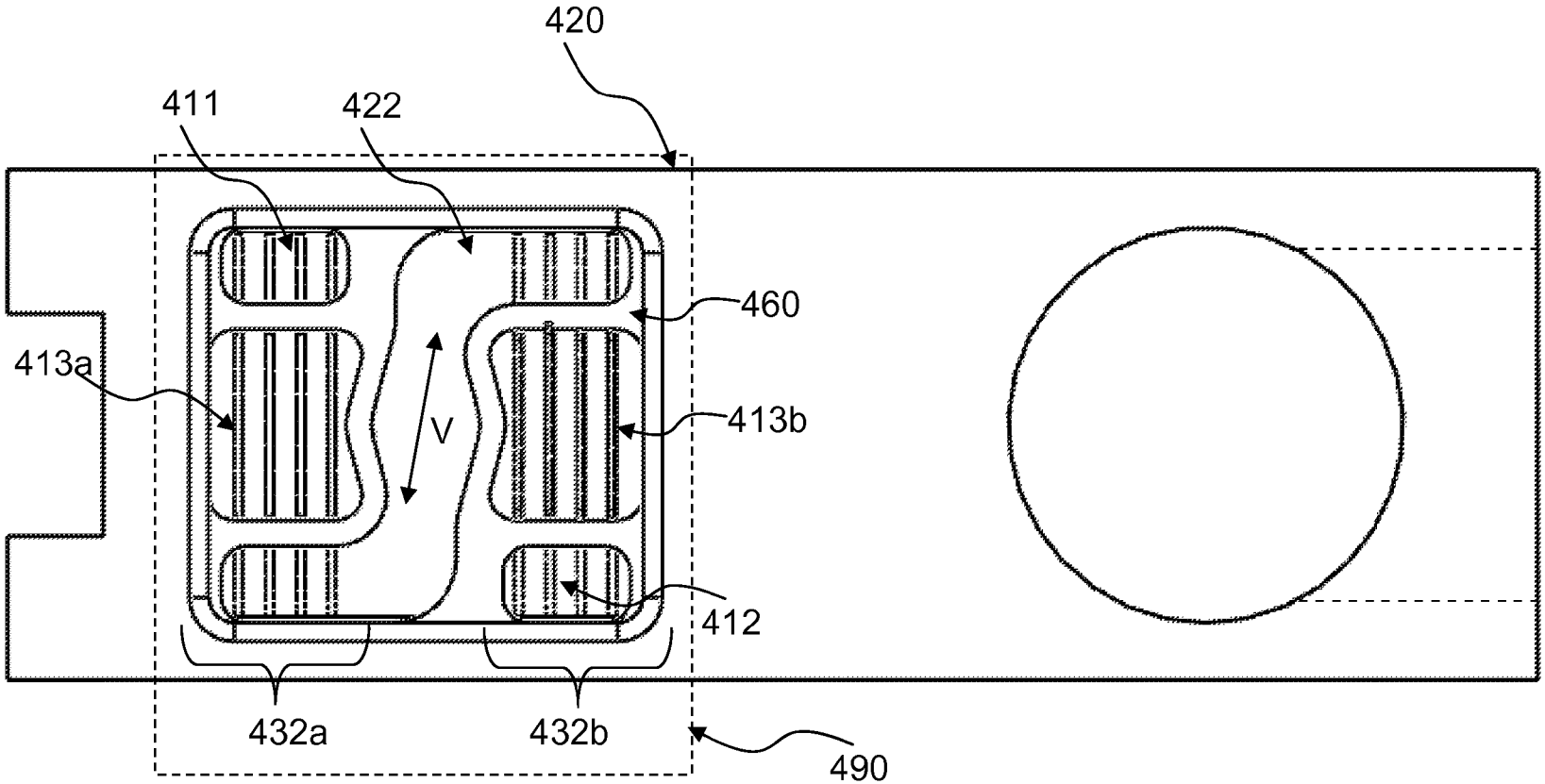
FIG. 12 is a schematic top view illustration of a housing of the adhesion rotary disc pump, according to the alternative embodiment of FIG. 11.
Figure 13:
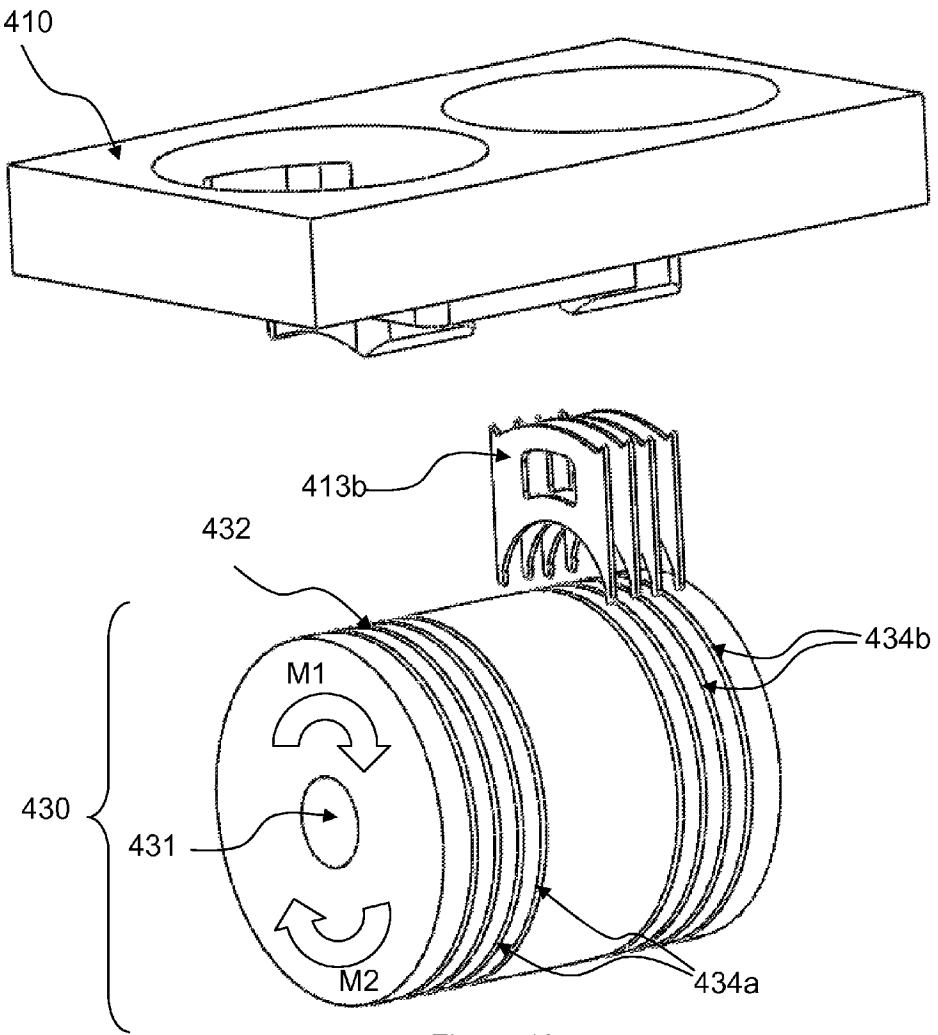
FIG. 13 is a partially exploded isometric view of a rotor, and a scraping unit, according to the alternative embodiment of FIG. 11.

Reference is now made to FIG. 11, FIG. 12 and FIG. 13. According to some embodiments of the invention, another given adhesion rotary disc pump 400 may employ a rotor 430 comprising a shaft 431 and at least one disc setup 490 of at least one first adhesion propelling disc 432*a* that communicates in series with at least one second adhesion propelling disc 432*b* via a central fluid-conveying chamber 422. Two Neighboring first adhesion propelling discs 432*a* are spaced to form first groove(s) 434*a*, and neighboring second adhesion propelling discs 432*a* are spaced to form second groove(s) 434*b*. First adhesion propelling disc(s) 432*a* and/or second adhesion propelling disc(s) 432*b* may be integrally formed with a shaft 431 or fixedly coupled to shaft 431. First adhesion propelling disc(s) 432*a* and thus first groove(s) 434*a* may be in communication with a collective inlet 411, whereas second adhesion propelling disc(s) 432*b* and thus second groove(s) 434*b* may be in communication with a collective outlet 412. It should be noted that depending on the rotational direction of rotor 430, collective inlet 411 may constitute collective outlet 412, and vice versa. Adhesion rotary disc pump 430 includes at least one first scraping pane 413*a* and at least one second scraping pane 413*b* that is operative to be fittingly adjustable within first groove(s) 434*a* and second groove(s) 434*b* of rotor 430, respectively. As is schematically illustrated, scraping pane(s) 413 are separate from cover 410, i.e., uncoupled from cover 410. Accordingly, scraping pane(s) 413 are individually placeable within groove(s) 434.

Rotation of rotor 430 may cause fluid to be adhesively conveyed by first adhesion propelling disc(s) 432*a* from first collective inlet 411 to scraping edges of first scraping pane(s) 413*a*, which scrape and thus channel the fluid from first groove(s) 434*a* to central fluid-conveying chamber 422. Due to pressure that may be continuously exerted on the fluid by first adhesion propelling disc(s) 432*a*, the fluid may engage with second adhesion propelling disc(s) 432*b*, which adhesively convey the fluid towards the scraping edges of second scraping pane(s) 413*b*, thereby channeling and expelling the fluid through collective outlet 412 in accordance with guiding walls 460. It should be noted that in some embodiments of the invention, the number of first groove(s) 434*a* may differ from the number of second groove(s) 434*b*.

It should be noted that if a disc setup includes only one adhesion propelling disc, the groove may refer to the space between the disc and the wall of the pump's housing 420 or guiding wall 460.

Figure 14:
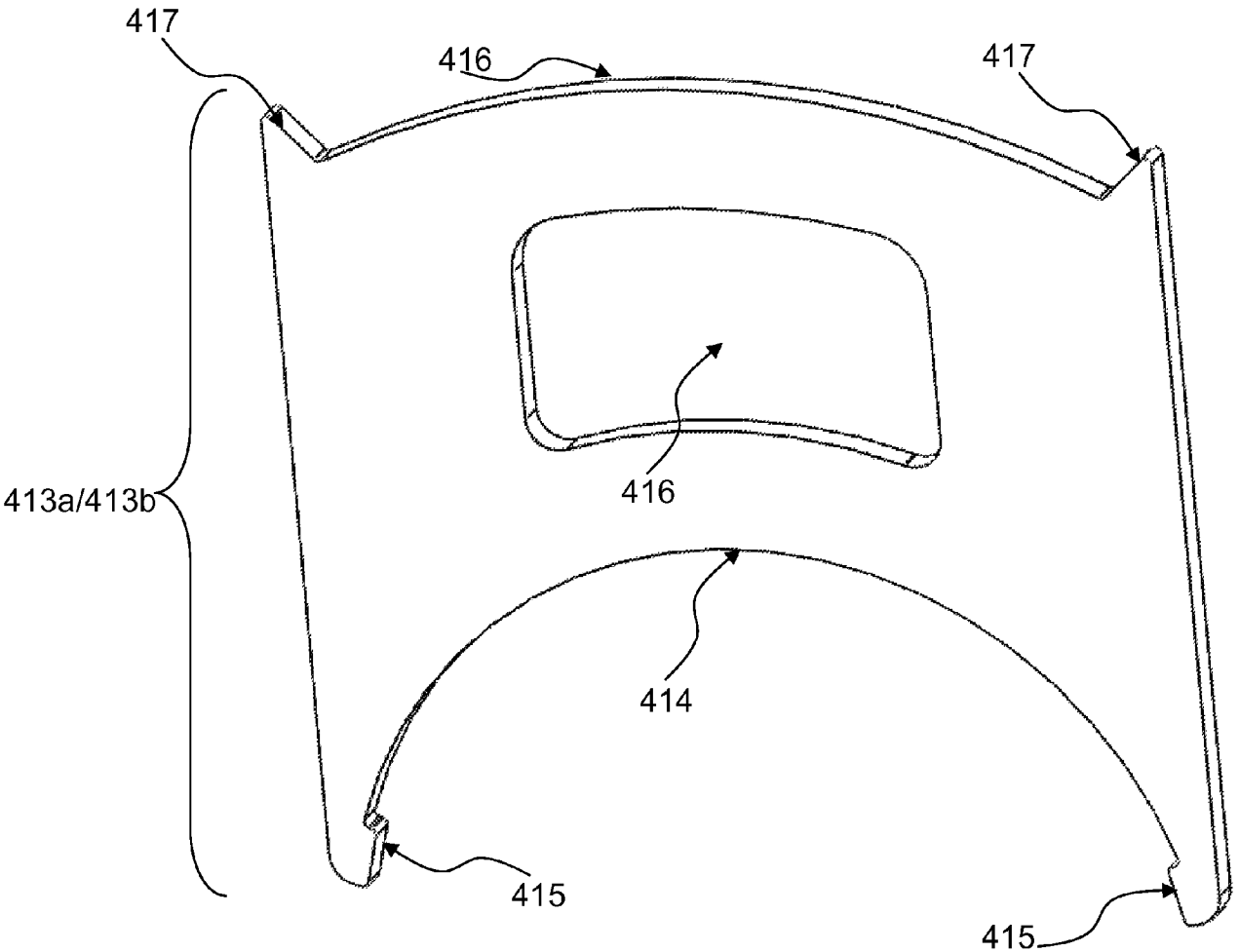
FIG. 14 is a detailed isometric view of a scraping pane, according to the embodiment of FIG. 11.

Reference is now made to FIG. 14. According to some embodiments of the invention, first scraping pane(s) 413*a* and/or second scraping pane(s) 413*b* may be arch-shaped and have a concave surface 414, which may abut against shaft 131 of second rotor 430. Optionally, concave surface 414 is equipped with protrusions 415 for mechanically couple, e.g., first scraping pane(s) 413*a*, in a frictional and/or latching manner with shaft 131. First scraping pane(s) 413*a* for example may further include a convex surface 416 with upwardly kinked tines 417. Convex surface 416 and upwardly kinked tines 417 may be detachably engagable with a cover of a housing 420 to secure the position of e.g., first scraping pane(s) 413*a* to prevent their rotation together with first adhesion-propelling discs 432*a*. In some embodiments, a scraping pane such as e.g., first scraping pane(s) 413*a* may include a hole 416 to reduce their weight and/or to reduce the surface area that is potentially in contact with, e.g., first adhesion-propelling disc(s) 432*a*. Hole 416 may reduce or minimize friction during the rotation of first adhesion propelling disc(s) 432*a*.

It should be noted that the above-mentioned adhesion based rotary disc pumps may be equipped with at least one bearing (e.g., a roller bearing, or a bush bearing) and/or at least one seal (e.g., a rotary shaft seal) for preventing leakage of fluid along shaft 131).

Figure 15B:
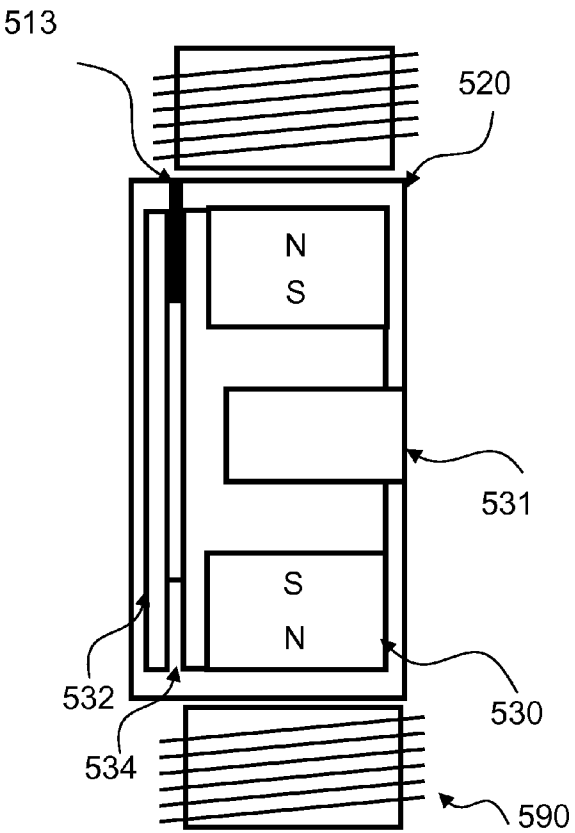
FIG. 15B is a schematic side view illustration of the yet other adhesion rotary disc pump operatively coupled with the drive, according to the embodiment of FIG. 15A.
Figure 15A:
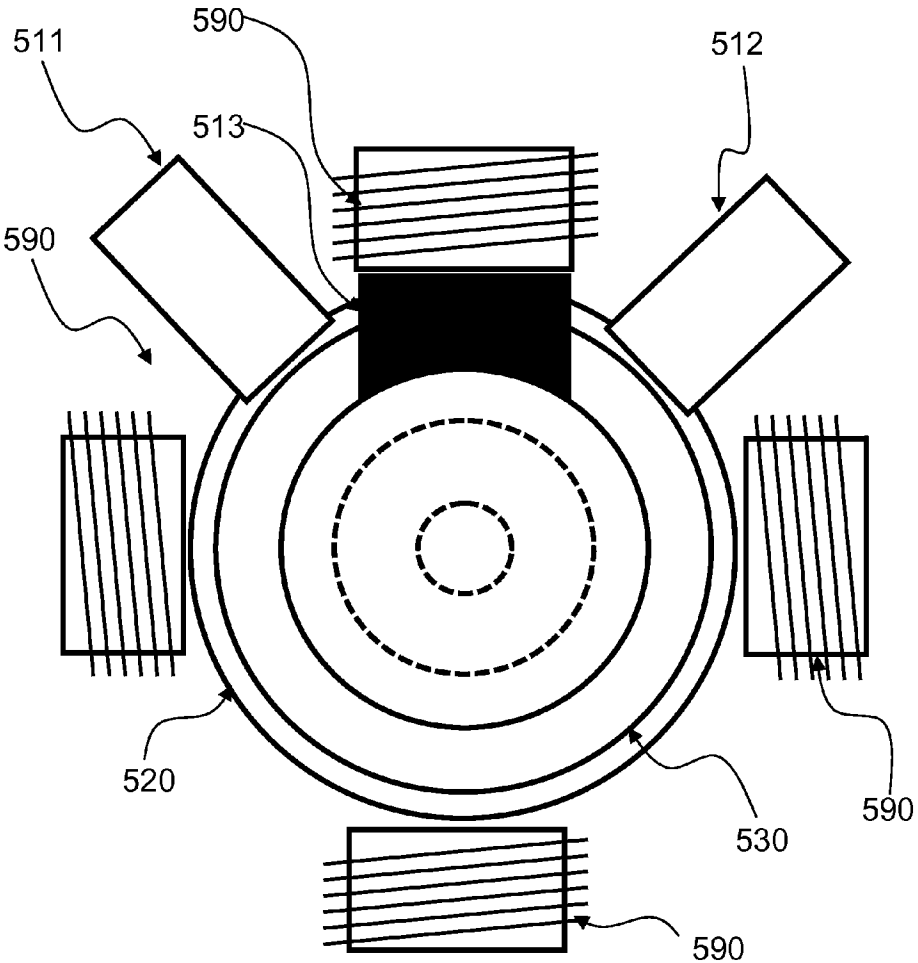
FIG. 15A is a schematic front view illustration of a yet other adhesion rotary disc pump operatively coupled with a drive, according to a yet alternative embodiment of the invention.

Reference is now made to FIG. 15A and to FIG. 15B. According to some embodiments of the invention, a adhesion rotary disc pump such as, for example adhesion rotary disc pump 500 which may have only one scraping pane 513 fittingly adjusted within a groove 534 of a rotor 530, may be driven by a drive 560, which may be embodied by a brushless motor comprising a plurality of coils 590 and a respective plurality of permanent magnets. The magnets may constitute or be a part of rotor 530, whereas coils 590 may constitute a stator. The magnets may be radially positioned between coils 590 and shaft 531.

Figure 16:
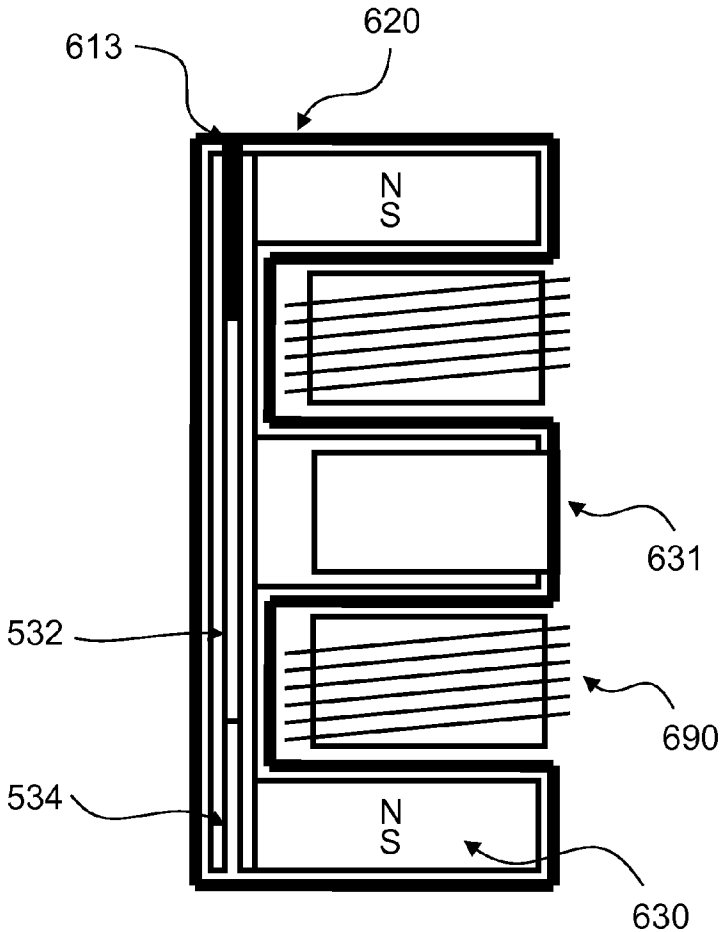
FIG. 16 is a schematic front view illustration of another alternative adhesion rotary disc pump operatively coupled with another drive, according to an embodiment of the invention.

Reference is now made to FIG. 16. According to some embodiments of the invention, a adhesion rotary disc pump such as, for example adhesion rotary disc pump 600 which may have only one scraping pane 613 fittingly adjusted within a groove 634 of a rotor 630, may be driven by a drive 660, which may embodied by another brushless motor. Drive 660 may comprise a plurality of coils 690 positioned between a respective plurality of permanent magnets, and a shaft 631, wherein the coils may constitute a stator and wherein the magnets may constitute or be a part of rotor 630.

It should be noted that the configuration of drives 560 and 660 obviate the requirement of employing of dynamic seals, which are operative to make a seal between moving surfaces.

It will be appreciated by persons skilled in the art that the disclosed invention is not limited to what has been particularly shown and described hereinabove.

It should be understood that an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions.

It should be understood that the phraseology and terminology employed herein is not to be construed as limiting and is for descriptive purpose only.

It should be understood that where the claims or specification refer to "a" or "an" element, such reference is not to be construed as there being only one of that element.

The descriptions, examples, methods and materials presented in the claims and the specification are not to be construed as limiting but rather as illustrative only.

What is claimed is:

1. An adhesion rotary disc pump comprising a housing and a cover, said housing embedding therein at least one adhesion-propelling disc mounted on a rotatable shaft that is drivable by a drive, said at least one adhesion-propelling disc having a thickness and two faces, wherein fluids engaging with said at least one adhesion-propelling disc are transportable from at least one inlet of said cover to at least one outlet of said cover;

wherein a scraping unit comprises at least one scraping pane that is positionable in said housing such to be operative to interact with said at least one adhesion-propelling disc such to scrape off fluid adherent on at least one of said faces of said at least one rotatable adhesion-propelling disc; and wherein said scraped-off fluid is being channeled directly or indirectly to said at least one outlet.

2. The adhesion rotary disc pump according to claim 1, wherein a plurality of adhesion-propelling discs is mounted on said rotatable shaft, wherein said plurality of adhesion-propelling discs are jointly interacting with said scraping unit.

3. The adhesion rotary disc pump according to claim 2, wherein each of said plurality of adhesion-propelling discs communicates with a respective one of said at least one inlet and said at least one outlet.

4. The adhesion rotary disc pump according to claim 2, wherein a first inlet of said at least one inlet communicates with a first adhesion-propelling disc and a final outlet of said at least one outlet communicates with a final adhesion-propelling disc, said scraping unit channeling the adhesively conveyed fluid received at said first inlet to said final outlet via a directly successive adhesion-propelling disc.

5. The adhesion rotary disc pump according to claim 2, wherein each of said plurality of adhesion-propelling discs communicates with a respective one of said at least one inlet and said at least one outlet, wherein a first inlet of said at least one inlet communicates with a first adhesion-propelling disc and a final outlet of said at least one outlet communicates with a final adhesion-propelling disc, said scraping unit channeling the adhesively conveyed fluid received at said first inlet to said final outlet via a directly successive adhesion-propelling disc.

6. The adhesion rotary disc pump according to claim 5, wherein said scraping panes terminate in respective concave surfaces that complimentary abut against the cylindrical surface of said shaft.

7. The adhesion rotary disc pump according to claim 5, wherein said scraping panes have a horizontal cross-section of a parallelogram such that said scraping panes feature one or two line-like scraping-edges running from the cover towards said shaft.

8. The adhesion rotary disc pump according to claim 5, wherein said scraping panes terminate in respective concave surfaces that complimentary abut against the cylindrical surface of said shaft wherein said scraping panes have a horizontal cross-section of a parallelogram such that said scraping panes feature one or two line-like scraping-edges running from the cover towards said shaft.

9. The adhesion rotary disc pump according to claim 8, wherein said scraping panes feature fluid-conveying faces emanating from said line-like scraping edges.

10. The adhesion rotary disc pump according to claim 1, wherein said drive and thus said adhesion-propelling discs are bidirectionally drivable.

11. The adhesion rotary disc pump according to claim 1, wherein said cover comprises at least one funnel to funnel said fluid either to said at least one inlet or outlet.

12. The adhesion rotary disc pump according to claim 1, wherein said housing comprises an opening that is partitioned by tapered and/or angled teeth into a plurality of fluid-conveying chambers, and the angle of teeth are corresponding to the direction of conveyance of the fluid.

13. The adhesion rotary disc pump according to claim 1, wherein at least one disc setup of at least one first adhesion propelling disc communicating in series with at least one second adhesion propelling disc via a central fluid-conveying chamber, wherein said first at least one adhesion propelling disc communicates with said inlet, and wherein said at least one second adhesion propelling disc communicates with said outlet.

14. The adhesion rotary disc pump according to claim 1, wherein said drive is a brushless motor such that said adhesion rotary disc pump is free of a seal.

15. The adhesion rotary disc pump according to claim 1, wherein said at least one scraping pane is mechanically coupled to said cover.

16. The adhesion rotary disc pump according to claim 1, wherein said at least one scraping pane is uncoupled from said cover and thus individually placeable in said housing.

* * * * *

UNITED STATES PATENT AND TRADEMARK OFFICE

CERTIFICATE OF CORRECTION

PATENT NO. : 8,308,425 B2
APPLICATION NO. : 12/639197
DATED : November 13, 2012
INVENTOR(S) : Noa Schmid It is certified that error appears in the above-identified patent and that said Letters Patent is hereby corrected as shown below:

Col. 1, line 19: "propelling liquid on the basis adhesion" should read as follows:
"propelling liquid on the basis of adhesion"

Col. 1, line 48: "when the machine is drive power" should read as follows:
"when the machine is driven by power"

Col. 5, line 22: "or by first and second adhesion propelling disc 132a and 132b" should read as follows: "or by first and second adhesion propelling discs 132a and 132b"

Col. 5, line 66-67: "and another instance" should read as follows:
"and at another instance"

Col. 6, line 48: "avoided or mized" should read as follows:
"avoided or minimized"

Col. 7, line 24-25: "Two Neighboring first adhesion propelling disc(s)" should read as follows:
"Two neighboring first adhesion propelling disc(s)"

Signed and Sealed this
Twelfth Day of February, 2013

Teresa Stanek Rea
*Acting Director of the United States Patent and Trademark Office*